United States Patent [19]

Taura et al.

[11] Patent Number: 4,535,736

[45] Date of Patent: Aug. 20, 1985

[54] METHOD AND APPARATUS FOR CONTROLLING AIR-FUEL RATIO IN INTERNAL COMBUSTION ENGINE

[75] Inventors: Mitsuharu Taura, Toyota; Toshiaki Mizuno, Nagoya, both of Japan

[73] Assignee: Toyota Jidosha Kabushiki Kaisha, Toyota, Japan

[21] Appl. No.: 601,341

[22] Filed: Apr. 17, 1984

[30] Foreign Application Priority Data

Apr. 18, 1983 [JP] Japan ..... 58-68174

[51] Int. Cl.[3] ..... F02M 51/00

[52] U.S. Cl. ..... 123/344; 123/391; 123/392; 364/431.05

[58] Field of Search ..... 123/344, 440, 443, 489, 123/589, 491, 492; 364/431.04, 431.05

[56] References Cited

U.S. PATENT DOCUMENTS 4,425,895 1/1984 Yoshida et al. ..... 123/489

4,434,768 3/1984 Ninomiya ..... 123/489

4,471,738 9/1984 Smojver ..... 123/489

*Primary Examiner*—Cuchlinski, Jr., William A.

*Attorney, Agent, or Firm*—Cushman, Darby & Cushman

[57] ABSTRACT

Disclosed is a method of controlling the air-fuel ratio of an air-fuel mixture to be supplied to an internal combustion engine. The method employs a feedback control in which the control is made to maintain the air-fuel ratio at the stoichiometric level in accordance with the air-fuel ratio read through the detection of a component of the exhaust gas and, at least during the idling of the engine after the warming up of the same, a lean control in which the control is made to maintain the air-fuel ratio at the leaner side of the stoichiometric level. The lean control is allowed when the mean value of the engine speed over a predetermined period is greater than a predetermined reference value during the idling after warming up of the engine, while the feedback control is conducted when the mean value is below the predetermined reference value. Disclosed also is an apparatus suitable for carrying out this method.

11 Claims, 22 Drawing Figures

METHOD AND APPARATUS FOR CONTROLLING AIR-FUEL RATIO IN INTERNAL COMBUSTION ENGINE

BACKGROUND OF THE INVENTION

The present invention relates to a method of and apparatus for controlling the air-fuel ratio of an air-fuel mixture which is to be supplied to an internal combustion engine. More particularly, the invention is concerned with an air-fuel ratio controlling method and apparatus in which the mode of air-fuel ratio control is switched selectively in accordance with the state of the engine operation between a feedback control mode in which the air-fuel ratio is controlled in conformity with the stoichiometric one and a feed-forward control mode referred to as "lean control" in which the control is made to maintain an air-fuel ratio greater than the stoichiometric value, i.e. to maintain a mixture leaner than the stoichiometric one.

Generally, in automotive engines equipped with an exhaust gas scrubber of ternary catalyst type, it is necessary to effect the air-fuel ratio control such that the air-fuel ratio, which is directly related to the condition of combustion in the engine, is always maintained around the stoichiometric level, in order to keep the exhaust emissions clean.

To cope with this demand, a feedback control method has been proposed and used in which the oxygen content in the exhaust gases is detected by an $O_2$ sensor as an index of the air-fuel ratio of the mixture, and the air-fuel ratio control is conducted in accordance with the output from the $O_2$ sensor such that the air-fuel ratio coincides with the stoichiometric ratio.

When the engine is operating under comparatively light load, it is possible to decrease the rate of fuel consumption by maintaining the air-fuel ratio at the leaner side of the stoichiometric value without being accompanied by substantial degradation of the exhaust emissions because, under the light load, the rate of generation of nitrogen oxides is sufficiently small. Under these circumstances, an automotive engine has been proposed in which the control operation mode is selectively switched between the feedback control mode for maintaining the air-fuel ratio at the stoichiometric level and the lean control mode for maintaining the mixture at the leaner side of the stoichiometric one through a feed-forward control, thereby to minimize the fuel consumption.

The lean control, however, is an open loop control so that, if the lean control is conducted during idling in which the combustion is unstable, the engine operation may become unstable and, in the worst case, the engine may be stalled.

SUMMARY OF THE INVENTION

Accordingly, it is a first object of the invention to provide a method of controlling the air-fuel ratio of mixture to be fed to an internal combustion engine, improved to permit a lean control even during idling, without being accompanied problems such as an unstable engine operation or engine stall.

It is a second object of the invention to provide an apparatus for controlling the air-fuel ratio of the mixture to be fed to an internal combustion engine, improved to permit a lean control even during idling of the engine without being accompanied by troubles such as unstable engine operation or engine stall.

To this end, according to the invention, in an internal combustion engine wherein the air-fuel ratio of an air-fuel mixture to be supplied to an internal combustion engine is controlled by selective use of a feedback control in which the control is made to maintain the air-fuel ratio at the stoichiometric level in accordance with the air-fuel ratio and a lean control in which the control is made to maintain the air-fuel ratio at the leaner side of the stoichiometric level at least during the idling of the engine after the warming up of the same, the lean control is executed when the mean value of the engine speed over a predetermined period is greater than a predetermined reference value during the idling after warming up of the engine and the feedback control is executed when the mean value is below the predetermined reference value.

It is, therefore, possible to execute the lean control during the idling after the warming up of the engine, without being accompanied by troubles such as unstable engine operation and engine stall. In addition, the control mode is shifted to the feedback control to ensure a sufficient engine out torque any time the load is applied to the engine.

These and other objects, features and advantages of the invention will become clear from the following description of the preferred embodiments taken in conjunction with the accompanying drawings.

and

Figure 20:
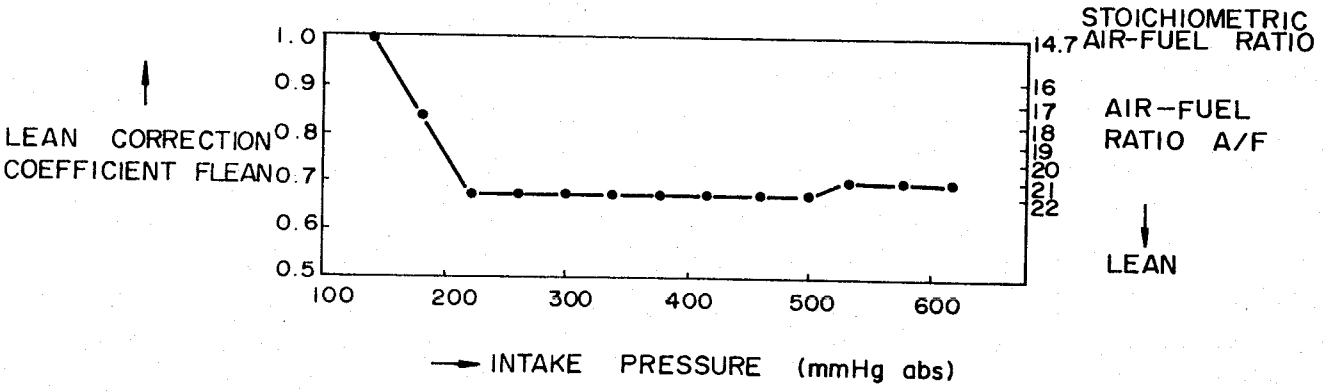

FIG. 20 is a graph showing the relationship between the correction coefficient FLEAN and the pressure PM.

DESCRIPTION OF THE PREFERRED EMBODIMENTS

Figure 1:
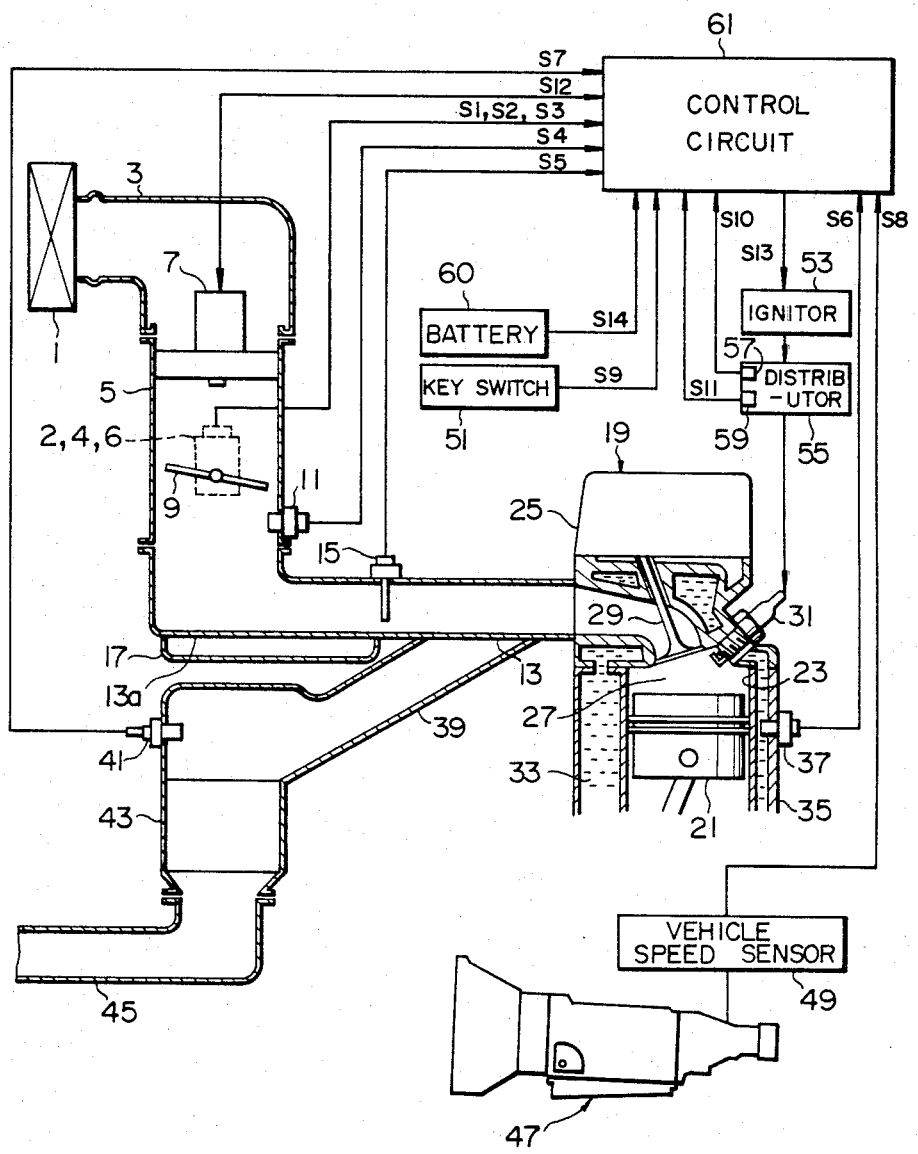
FIG. 1 is a schematic block diagram of an automotive internal combustion engine to which the present invention is applied.

FIG. 1 shows an example of an automotive internal combustion engine having an electronic fuel injection system to which the invention is applied. An air filter 1 is connected to a throttle body 5 through an inlet pipe 3. The throttle body 5 is provided at its upstream side with a fuel injector 7. A throttle valve 9 disposed at the downstream side of the fuel injector 7 is operatively connected to an accelerator pedal (not shown) so as to control the intake air flow rate in accordance with the position of the accelerator pedal (not shown). An absolute intake pressure sensor 11 disposed at the downstream side of the throttle valve 9 is adapted to sense the absolute pressure of the intake air at that portion. The throttle valve 9 is associated with various other parts such as a valve open position sensor 2 for measuring the opening degree of the throttle valve 9, an idle switch 4 which takes one position only when the throttle valve 9 is fully closed or substantially fully closed, and a power switch 6 which is kept in on state when the opening degree of the throttle valve 9 exceeds a predetermined value such as, for example, 40°.

The throttle body 5 is connected to an intake manifold 13 having branch pipes leading to respective cylinders of the engine. The intake manifold 13 is provided with an intake air temperature sensor 15 adapted to sense the temperature of the intake air in the intake manifold 13. The intake manifold 13 is provided on the bottom wall 13*a* thereof at the upstream side of the branching point with a riser portion 17 through which the heated cooling water is circulated to heat the air-fuel mixture through the wall of the intake manifold.

A reference numeral 19 designates the body of the engine known per se. The engine is provided with a plurality of cylinders 23, pistons 21 and cylinder heads 25 which in combination define combustion chambers 27 (only one of them is shown). Each cylinder is provided with an intake valve 29 through which the air-fuel mixture is introduced into the combustion chamber 27. The mixture is then ignited by an ignition plug 31. During the operation, the cylinder 23 and other associated parts are cooled by cooling water which is circulated through a water jacket 33 formed around the cylinder 23. The temperature of the cooling water in the water jacket 33 is sensed by a cooling water temperature sensor 37 attached to the outer wall of the clinder block 35.

Branch pipes of an exhaust manifold 39 are connected to the exhaust ports (not shown) formed in the cylinder heads 25 of respective cylinders 23. The exhaust manifold 39 is provided at its downstream end portion with $O_2$ sensor 41 adapted to sense the residual oxygen content in the exhaust gas. The exhaust manifold 39 is connected to an exhaust pipe 45 through a ternary catalyst 43.

The speed of the automobile is sensed by a vehicle speed sensor 49 which is attached to the final output shaft of a transmission 47 coupled to the body 19 of the engine. Reference numerals 51, 53 and 55 denote, respectively, a key switch, igniter and a distributor. The distributor 55 is provided with an Ne sensor 57 adapted to produce an on-off signal for each angle $\theta 1$ of the crank rotation. It is possible to detect the engine speed and desired angular position of the crank from the output of the Ne sensor 57. A G sensor 59 which also is provided in the distributor 55 produces an on-off signal for each angle of $\theta 2$ of crank rotation greater than the above-mentioned angle $\theta 1$. The discrimination or identification of the cylinders and detection of the top dead centers are made by processing the output signal from the G sensor 59. A reference numeral 60 designates a battery.

A control circuit 61 is connected to various sensors such as the valve position sensor 2, idle switch 4, power switch 6, intake pressure sensor 11, intake air temperature sensor 15, cooling water temperature sensor 37, $O_2$ sensor 41, vehicle speed sensor 49, key switch 51, Ne sensor 57, G sensor 59 and the battery 60. Thus, the control circuit 61 receives from these sensors various signals such as a throttle valve opening degree signal S1, idle signal S2, power signal S3, intake pressure signal S4, intake air temperature signal S5, water temperature signal S6, air-fuel ratio signal S7, vehicle speed signal S8, start signal S9, engine speed signal S10, cylinder identification signal S11 and the battery voltage signal S14.

The control circuit 61 is connected also to the fuel injector 7 and the igniter 53 so that it can produce a fuel injection signal S12 and a ignition signal S13.

Figure 2:
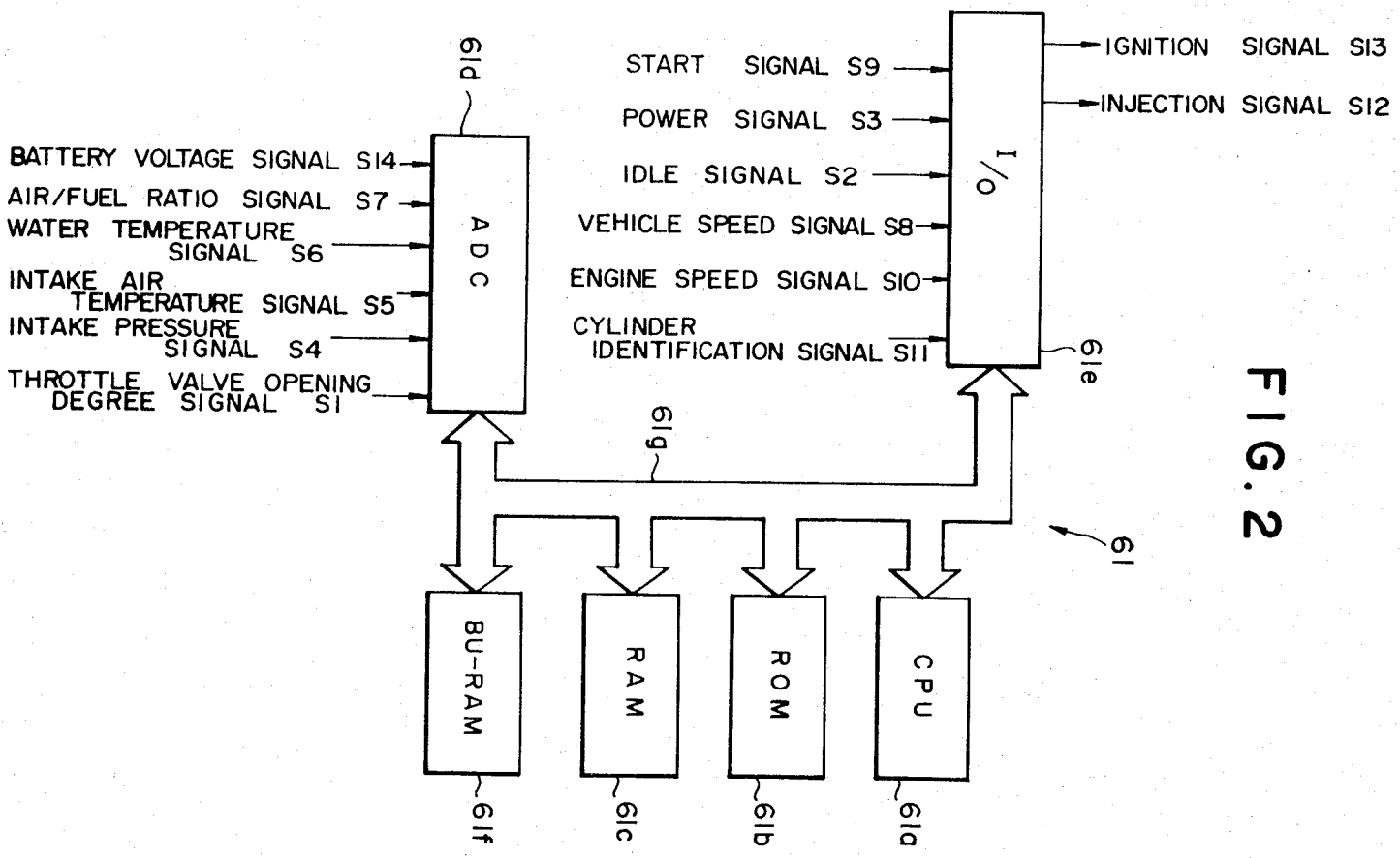
FIG. 2 is a detailed block diagram showing an example of the control circuit incorporated by the engine shown in FIG. 1.

As shown in FIG. 2, the control circuit 61 has the following parts or constituents: a central processing unit (CPU) 61*a* for controlling various devices; read only memory (ROM) 61*b* in which written are various numerical values and programs; a random access memory (RAM) 61*c* having regions in which written are numerical values obtained in the course of computation, as well as flags; an A/D converter (ADC) 61*d* for converting analog input signal into digital signals; an input/output interface (I/O) 61*e* through which various digital signals are inputted into and outputted from the control circuit; a backup memory (BU-RAM) 61*f* adapted to be supplied with electric power from an auxiliary power source when the engine is not operating thereby to hold the contents of the memory; and a BUS line 61*g* through which these constituents are connected to one another. Programs which will be detailed later are written in the ROM 61*b*.

Figure 3:
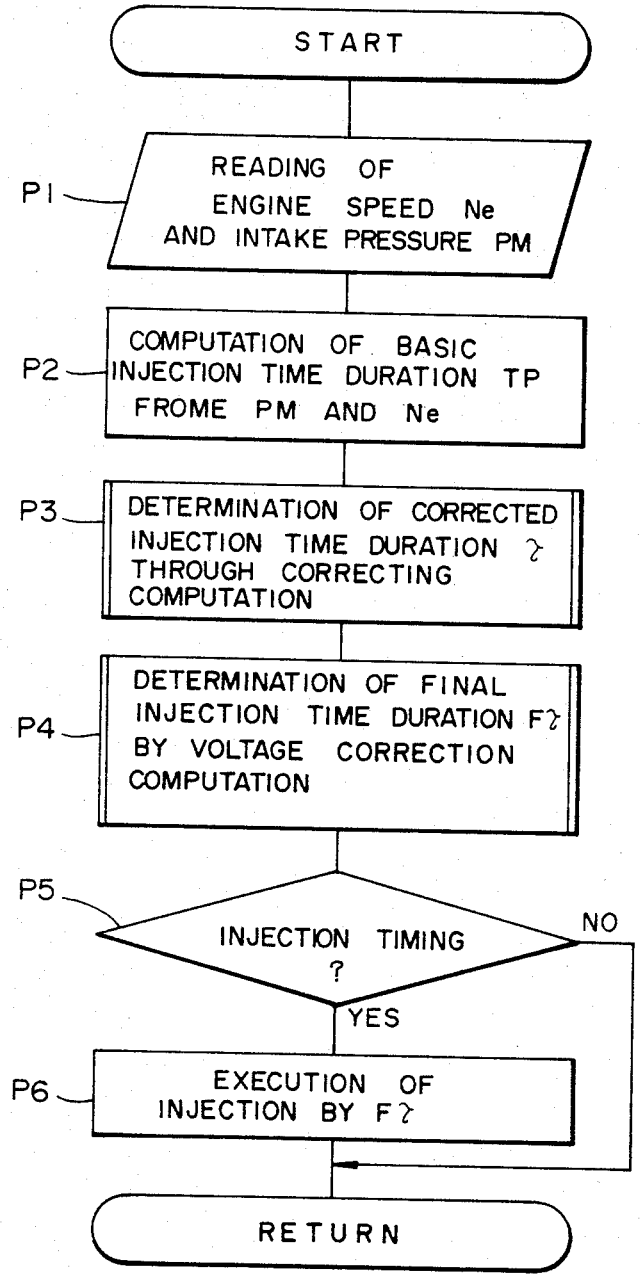
FIG. 3 is a flow chart showing an example of fuel injection process.
Figure 4:
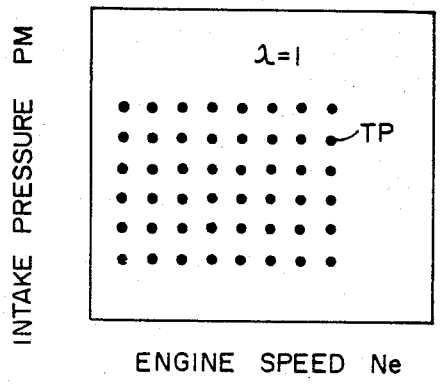
FIG. 4 is a diagram showing a map for determining the basic fuel injection time duration TP with parameters of the engine speed Ne and the intake pressure PM.

In the operation of the engine described above, fuel is injected in accordance with the flow chart shown in FIG. 3. More specifically, in a step P1, the engine speed Ne is read in the form of the engine speed signal S1 which is the reference position signal. At the same time, the intake pressure PM is read in the form of an intake pressure signal S4. In a step P2, the basic injection time duration TP is read from the map shown in FIG. 4 using the read values of the engine speed Ne and the intake pressure PM. In a step P3, a corrected injection time duration $\tau$ is determined through a computation which is conducted in accordance with the operating condition of the engine.

A detailed description will be made hereinunder as to the process for computing the corrected injection time duration $\tau$ in the step P3.

The injection time duration $\tau$ is generally obtainable from the following formula.

$$\tau=(TP+TAG)\times(1+KG)\times FWL\times FAF\times FTHA\times(FTC+FLEAN)\ldots \quad (1)$$

where, TP represents the basic fuel injection time duration, TAG represents the learning control amount, KG represents the learning control correction coefficient, FWL represents the warm-up incremental coefficient, FAF represents the air-fuel ratio feedback coefficient, FTC represents the transient-period air-fuel ratio correction coefficient, FTHA represents the intake air temperature correction coefficient, and FLEAN represents the lean correction coefficient.

Figure 5:
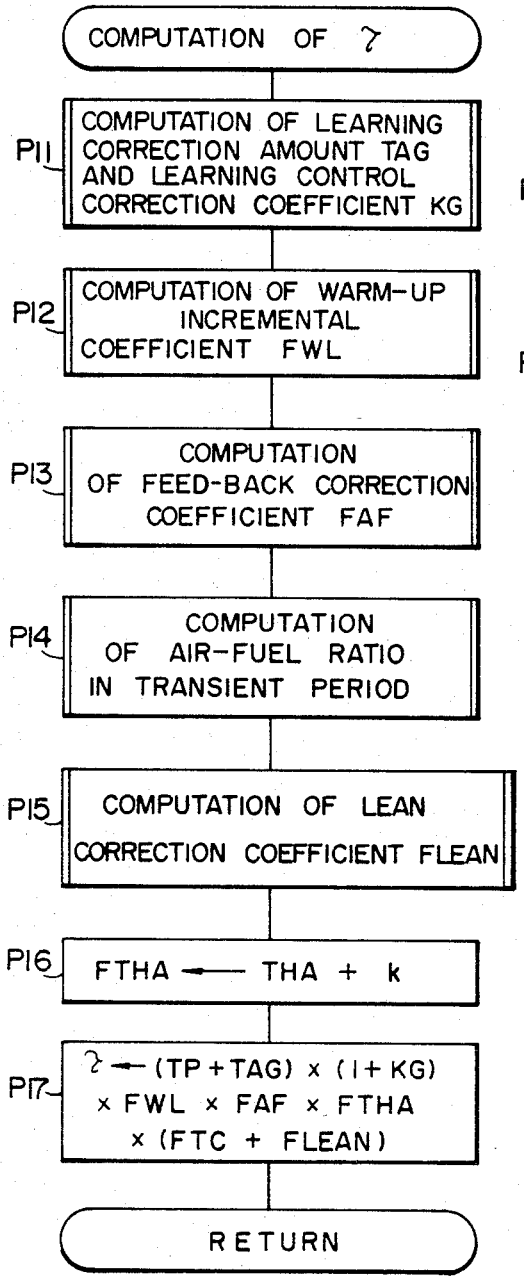
FIG. 5 is a flow chart showing an example of the process for determining corrected fuel injection time duration $\tau$.

These coefficients are calculated in accordance with the operation routine shown in FIG. 5 and the injection time duration $\tau$ is determined using these coefficients. Namely, in a step P11, a calculation is made to determine the learning control amount TAG and learning control correction coefficient KG, while in a step P12, computation is made to determine the warm-up incremental coefficient FWL. In a step P13, a calculation is made to determine the air-fuel ratio feedback correction coefficient FAF. In the next step P14, a calculation is made to determine the air-fuel ratio correction coefficient FTC in the transient period. Subsequently, a calculation is made to determine the lean correction coefficient FLEAN in a step P15. Then, in a step P16, a calculation is made to determine the value of (THA+k), thereby to determine the correction factor FTHA. Finally, the computation is conducted in a step P17 in accordance with the formula (1) above, and the process is returned to the step P4 of the routine shown in FIG. 3.

A description will be made hereinunder as to the computing processes performed in the steps P11 to P15.

Figure 6:
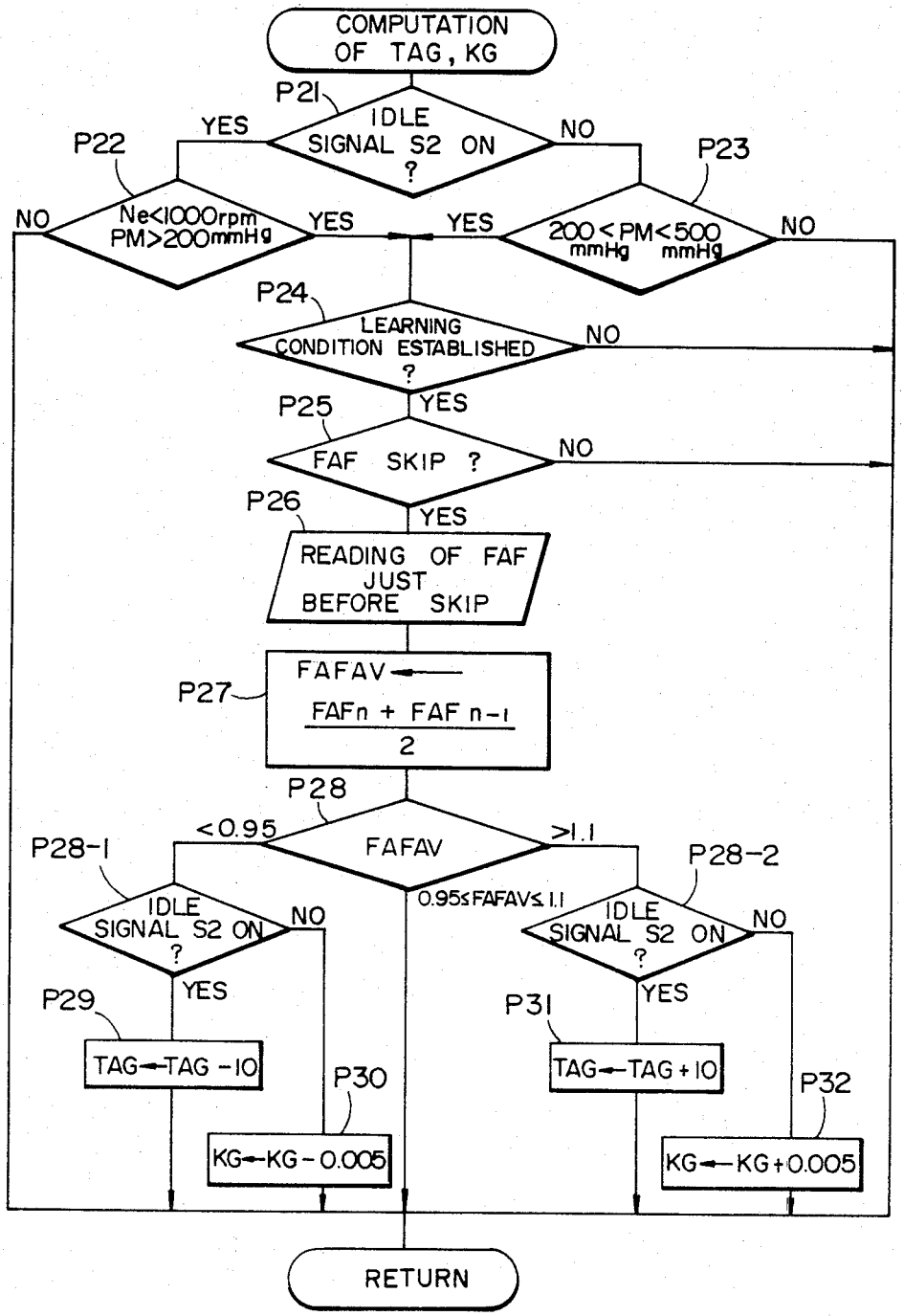
FIG. 6 is a flow chart showing an example of the process for computing learning correction amount TAG and learning control correction coefficient KG.

(1) Computation of Learning Control Amount TAG and Learning Control Correction Coefficient KG An example of the process for computing the learning control amount TAG and the learning control correction coefficient KG will be explained hereinunder with reference to FIG. 6.

In a step P21, a judgement is made as to whether the throttle valve 9 has been closed fully or not, through discriminating whether the idle signal S2 from the idle switch S4 is on or off. If an affirmative judgement is made, i.e. if the full closing of the throttle valve 9 is confirmed, a judgement is made in a step P22 as to whether the engine speed Ne is less than, for example, 1000 rpm and as to whether the intake pressure PM is greater than, for example, 200 mmHg. If an affirmative result is obtained in this judgement, the process proceeds to a step P24 for making the learning control.

On the other hand, if a negative answer is obtained in the step P21, i.e. if it is confirmed that the throttle valve 9 is not fully closed, a judgement is made in a step P23 as to whether the intake pressure is higher than, for example, 200 mmHg and below 500 mmHg. If the answer is affirmative, the process proceeds to the step P24 to conduct the learning control.

However, if the result of the judgement in the step P22 or P23 indicates a negative answer, the learning control is not conducted.

In the step P24, a judgement is made as to whether the conditions for the learning are met. For instance, the above learning amount TAG and learning control correction coefficient KG are learned when the cooling water temperature THW is above 80° and the intake air temperature THA falls between 40° and 90° C. while the engine is operating in the air-fuel ratio feedback control mode. If it is judged that the conditions for the learning are met, a judgement is made in a step P25 as to whether the feedback correction coefficient FAF has been skipped or not. If the answer is affirmative, i.e. if skipped, the process proceeds to a step P26. The judgement in the step P25 is made by detecting the change of states of the later-mentioned flags CAFL and CAFR from "1" to "0". In the step P26, the correction coefficient FAF immediately before the skipping is read and then, in a step P27, the arithmetic mean FAFAV of the presently read correction coefficient FAFn and the previously read correction coefficient $FAF_{n-1}$ is determined and stored in a predetermined area. The level of the arithmetic mean FAFAV is judged in the next step P28.

If the value of the arithmetic mean FAFAV is smaller than 0.95, a judgement is made to whether the throttle valve 9 is fully closed or not in a step P28-1. If yes, the process proceeds to a step P29 in which 10 is subtracted from the learning control amount TAG. The result of this subtraction is stored in the predetermined area as the new learning control amount TAG. If a judgement is made in the step 28-1 that the throttle valve 9 is not fully closed, the process proceeds to a step P30 in which 0.005 is subtracted from the learning control correction coefficient. The result of this subtraction is stored in the predetermined area as the new learning control correction coefficient KG.

If the value of the arithmetic mean FAFAV is greater than 1.1, a judgement is made as to whether the throttle valve 9 is fully closed or not in a step P28-2. If yes, the process proceeds to a step P31 in which 10 is added to the learning control amount TAG. The result of this addition is stored in the predetermined area as the new learning control amount TAG. If a judgement is made in the step 28-2 that the throttle valve 9 is not fully closed, the process proceeds to a step P32 in which 0.005 is added to the learning control correction coefficient. The result of this addition is stored in the predetermined area as the new learning control correction coefficient KG.

In sum, the air-fuel ratio is learned by the learning control amount TAG when the throttle valve is fully closed, whereas the air-fuel ratio is learned by the learning control correction coefficient KG when the throttle valve is opened.

The thus determined learning correction amount TAG is used in the correction of the basic fuel injection time duration regardless of the opening degree of the throttle valve, whereas the learning control correction coefficient KG is used for the similar correction only within the learned region of engine operation where the learning control correction coefficient KG is learned.

(2) Computation of Warm-Up Incremental Coefficient FWL

Figure 8:
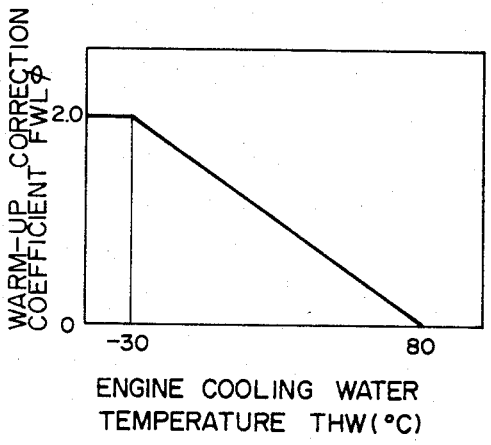
FIG. 8 is a graph showing the relationship between the engine water temperature THW and warm-up correction coefficient FWL$\phi$.
Figure 9:
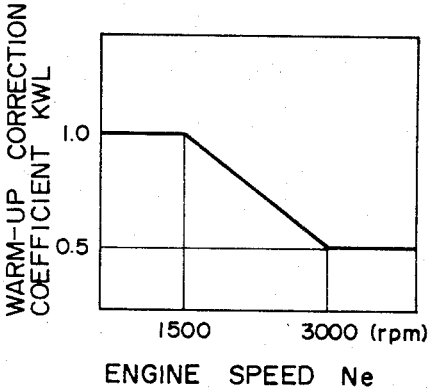
FIG. 9 is a graph showing the relationship between the engine speed Ne and the warm-up correction coefficient KWL.
Figure 7:
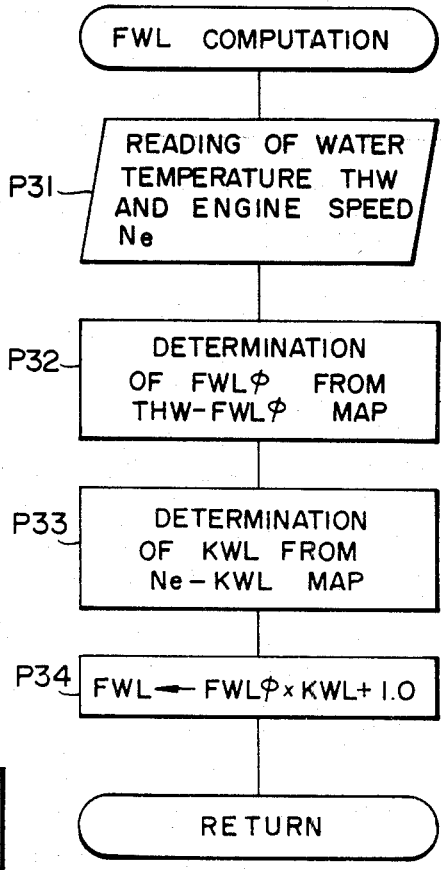
FIG. 7 is a flow chart showing an example of the process for computing the warm-up incremental coefficient FWL.

An example of the process for computing the warm-up incremental coefficient FWL is shown in FIG. 7. The cooling water temperature THW and the engine speed Ne are read in a step P31. In the next step P32, the correction coefficient FWLϕ is determined on the basis of the thus read newest cooling water temperature THW using a map which shows, as will be seen from FIG. 8, the relationship between the cooling water temperature THW and the correction coefficient FWLϕ. In the next step P33, the correction coefficient KWL is determined on the basis of the thus read newest engine speed Ne using a map which shows, as will be seen from FIG. 9, the relationship between the engine speed Ne and the correction coefficient KWL. Then, in a step P34, the value (FWLϕ×KWL)+1.0 is computed thus completing this process.

(3) Computation of Feedback Correction Coefficient FAF

Figure 10:
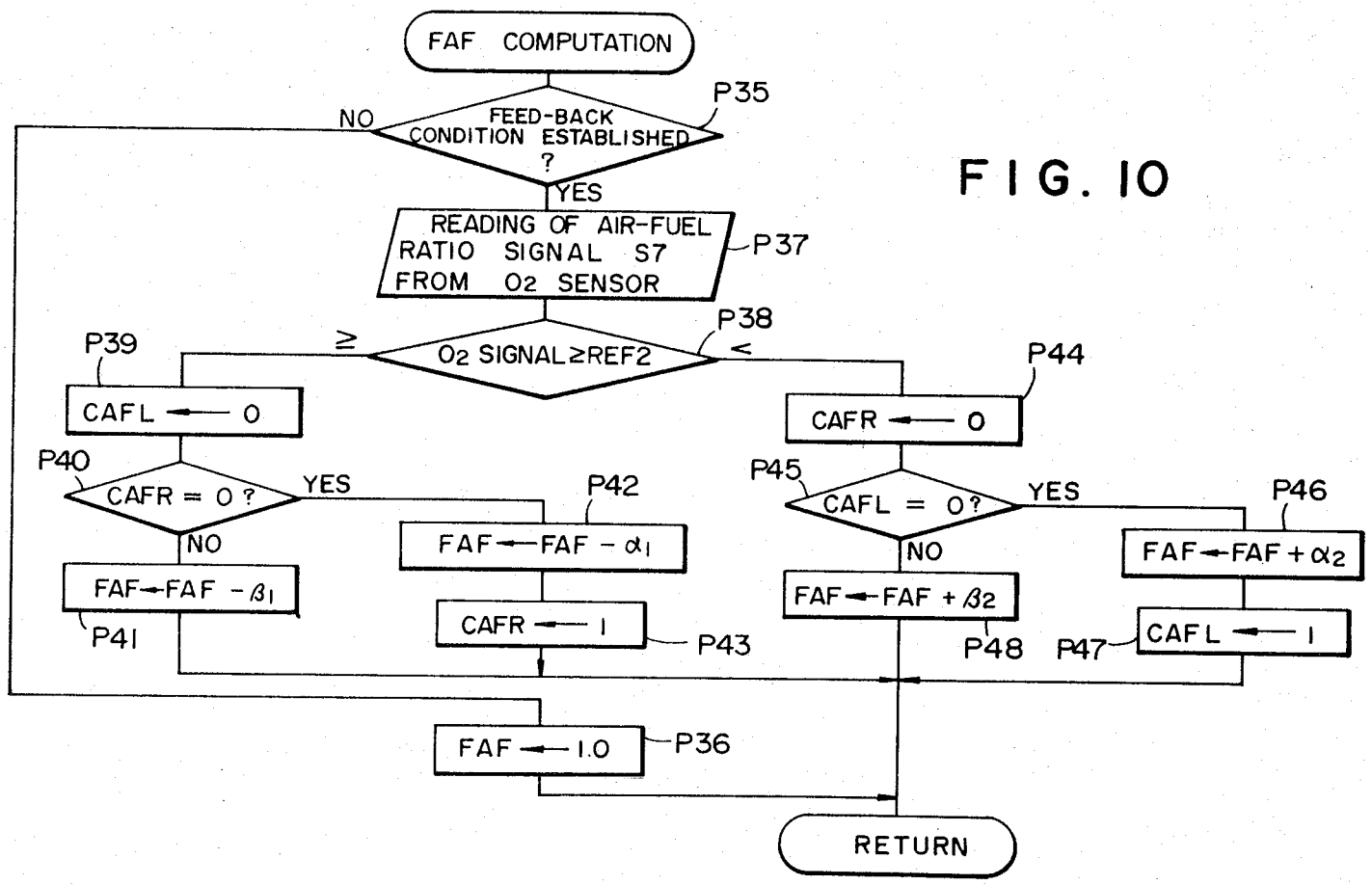
FIG. 10 is a flow chart showing an example of the process for computing the feedback correction coefficient FAF.

An example of the process for computing the feedback correction coefficient FAF is shown in FIG. 10.

A judgement is made in a step P35 to judge whether the condition for the feedback control has been established. The condition for the feedback control is established when all of the following requirements are met: the engine is not being started nor in the power incremental mode after start-up; the cooling temperature is not lower than 40° C.; and the engine is not in the power incremental mode nor in the lean control mode. If the condition for the feedback control has not been established, the feedback correction coefficient FAF is set at 1.0 in the step P36 to prohibit the feedback control thereby to complete this process. On the other hand, if the condition for the feedback control has been established, the process proceeds to a step P37.

The air-fuel ratio signal S7 is read in the step P37. In a step P38, this air-fuel ratio signal S7 is compared with a reference value REF2. When the level of the signal S7 exceeds the reference value REF2, it is judged that the air-fuel ratio is too small, i.e. the mixture is too rich, and the process is started to increase the air-fuel ratio, i.e. to make the mixture more lean.

Namely, after setting the flag CAFL at zero in a step P39, the process proceeds to a step P40 in which a judgement is made as to whether or not the state of the flag CAFR is zero. If the process has been shifted to richer side for the first time, the state of the flag CAFR is zero so that the process proceeds to a step P42 in which a predetermined value α1 is subtracted from the correction coefficient FAF stored in the RAM 61C and the result of this calculation is used as new correction coefficient FAF.

In the step P43, the flag CAFR is set to be 1. Therefore, if the air-fuel mixture is judged to be too rich in successive two judging cycles in the step P38, negative judgement is made without fail in the step P40 in the second and the following judging cycles, so that the process proceeds to a step P41 in which a predetermined value β1 is subtracted from the correction coefficient FAF. The result of this calculation is then stored in a predetermined area as the new correction coefficient FAF, thus completing the computation of FAF.

On the other hand, if the judgement in the step P38 proves the level of the signal S7 to be smaller than the reference value REF2, it is judged that the air-fuel ratio is too large, i.e. the mixture is too lean, so that a process is taken to decrease the air-fuel ratio, i.e. to make the mixture richer.

More specifically, the process proceeds to a step P45 after setting the flag CAFR at zero in a step P44. In the step P45, a judgement is made as to whether state of the flag CAFL is zero or not. If the process has been shifted to leaner side for the first time, th process proceeds to a step P46 because the state of the flag CAFL is zero. In the step P46, a predetermined value α2 is added to the correction coefficient FAF and the result of this addition is used as the new FAF. In a step P47, the state of the flag CAFL is set to be 1. Therefore, if the mixture is judged to be too lean in two successive judging cycles in the step P38, a negative judgement is made without fail in the second and the following judging cycles in the step P45. Then, the process proceeds to a step P48 in which a predetermined value β2 is added to the correction coefficient FAF and the result of this addition is used as the new FAF, thus completing the FAF operation. The values α1, α2, β1 and β2 used in the steps P41, P42, P46 and P48 are the values which have been determined beforehand.

Figure 11:
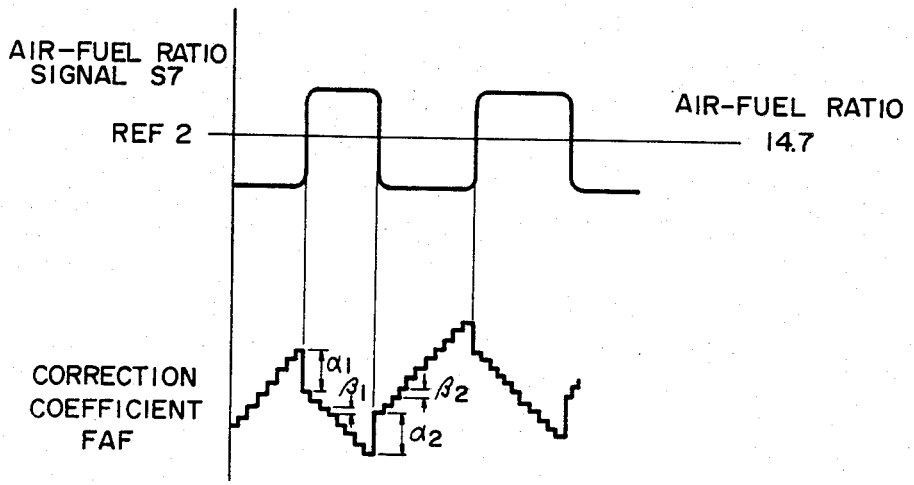
FIG. 11 is a time chart showing how the air-fuel ratio signal S7 and the correction coefficient FAF are changed in relation to time.

The feedback correction coefficient FAF determined through this operation is shown in FIG. 11 together with the air-fuel ratio signal S7. The following will be noted from this Figure. Namely, when the signal S7 rises above the reference value REF2 or drops below the same, the correction coefficient FAF is skipped by an amount α1 or α2. Thereafter, when the signal S7 exceeds the reference value, the predetermined value β1 is subtracted successively, whereas, if the signal S7 is below the reference value, the predetermined value β2 is added successively.

Figure 13:
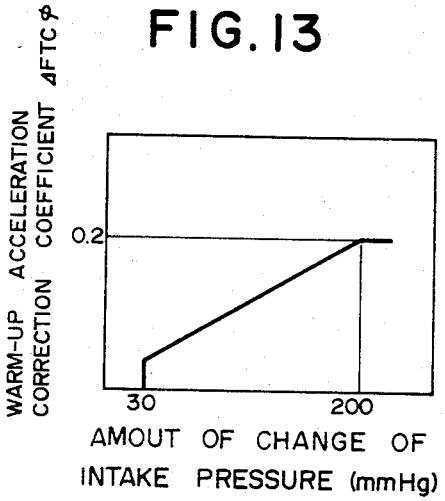
FIG. 13 is a graph showing the relationship between the amount of change of the intake pressure DPM and the correction coefficient $\Delta FTC\phi$.
Figure 12:
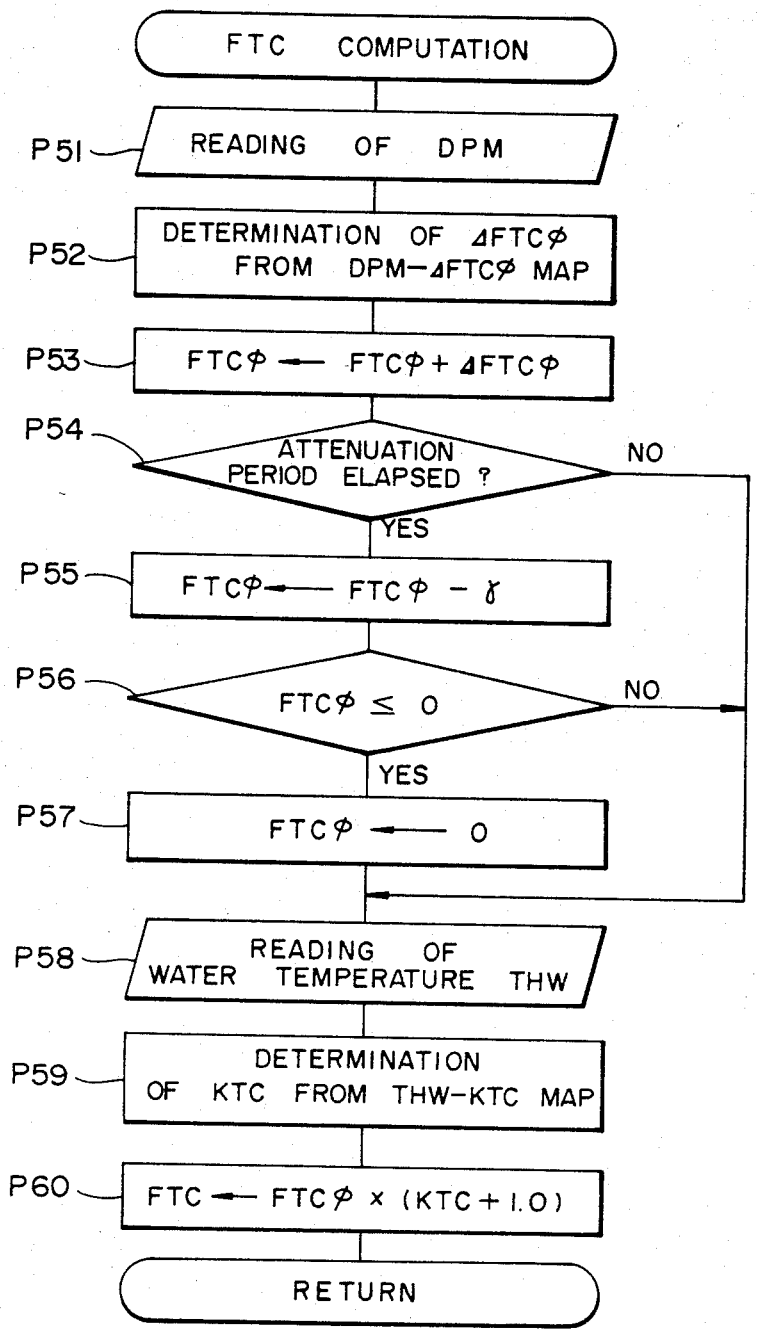
FIG. 12 is a flow chart showing an example of the process for computing the warm-up acceleration incremental coefficient FTC.

(4) Computation of Air-Fuel Ratio Correction Coefficient FTC in Transient Period An example of the process for computing the air-fuel ratio correction coefficient FTC in transient period is shown in FIG. 12. In this example, only the correction coefficient FTC in the acceleration incremental mode during warming up of the engine is discussed. The changing amount DPM of the intake pressure PM has been calculated suitably, and is read suitably in a step P51. Then, in a step P52, the correction coefficient ΔFTCϕ is determined in accordance with the changing amount DPM from a map which shows, as will be seen from FIG. 13, the relationship between the changing amount DPM and the warm-up acceleration correction coefficient ΔFTCϕ due to the changing amount in the intake pressure. In the next step P53, the correction coefficient ΔFTCϕ thus determined in the step P52 is added to the correction factor FTCϕ which has been determined already, and the sum is used as the new correction factor FTCϕ. The step then proceeds to a step P54 in which a judgement is made as to whether or not a predetermined period of time necessary for attenuating the thus obtained correction coefficient FTCϕ by an amount γ has been elapsed. If the result of the judgement is affirmative, the process proceeds to a step P55. In the step P55, a computation is made to determine the value of (FTCϕ-γ) and the result of this computation is stored in a predetermined area as a new correction coefficient FTCϕ. Then, in a step P56, a judgement is made as to whether the correction coefficient FTCϕ is smaller than zero. If the result of this judgement is affirmative, the correction coefficient FTCϕ is set to be zero in a step P57 and the procees proceeds to the next step P58. If the negative answer is obtained through the judgement in the step P54 or the step P56, the process also jumps to the step P58.

Figure 14:
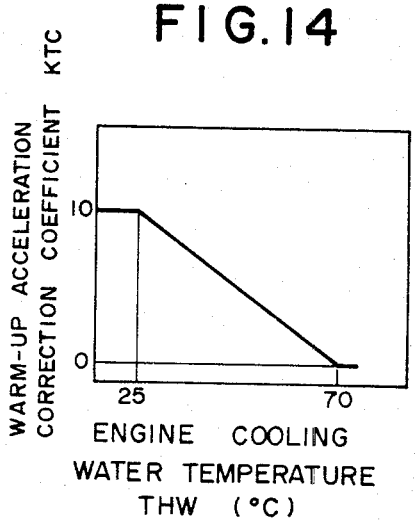
FIG. 14 is a graph showing the relationship between the engine cooling water temperaturee THW and the correction coefficient KTC.

In a step P58, the cooling water temperature THW is read in the form of the water temperature signal S6. In the next step P59, the correction coefficient KTC is read on the basis of this cooling water temperature THW from a map which shows, as will be seen from FIG. 14, the relationship between the cooling water temperature THW and the warm-up acceleration correction coefficient KTC. The process then proceeds to a step P60 in which a computation of $FTC\phi \times (KTC+1.0)$ is made to determine the warm-up acceleration correction coefficient FTC.

Figure 15:
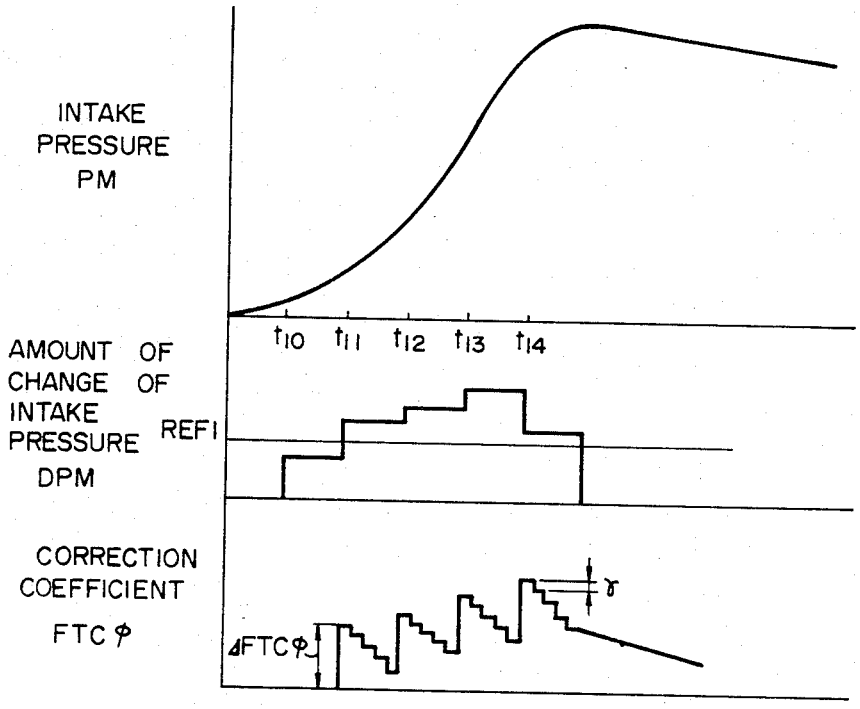
FIG. 15 is a time chart showing how the intake pressure PM, changing amount DPM of the same and the correction coefficient $FTC\phi$ are changed in relation to time.
Figure 16:
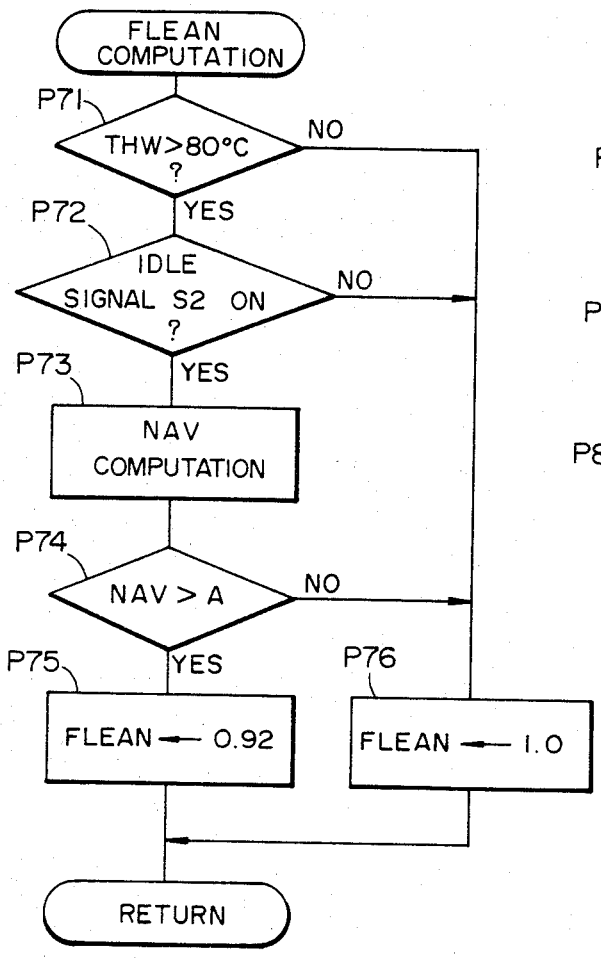
FIG. 16 is a flow chart showing an example of the process for computing the lean correction coefficient FLEAN.

The correction coefficient $FTC\phi$ obtained through the steps P51 to P55 is shown in FIG. 15 together with the intake pressure PM and the changing amount DPM of the same. As will be seen from this Figure, a predetermined value $\Delta FTC\phi$ is added to the correction coefficient $FTC\phi$ at each time the changing amount DPM at every time points t10–t14 exceeds the reference value REF 1. At the same time, in the time interval between the successive time points the attenuation value $\gamma$ is subtracted from the correction factor $FTC\phi$ at a predetermined period.

(5) Computation of Lean Correction Coefficient FLEAN

In a step P71, a judgement is made as to whether or not the cooling water temperature THW is high enough to complete the warm-up of the engine, i.e. whether or not is is raised to 80° C., for example. If the answer is affirmative, the process proceeds to a step P72 in which a judgement is made as to whether the throttle valve 9 is fully closed, by using the idle signal S2 derived from the idle switch 4. If the throttle valve 9 is fully closed, a computation is made in the step P73 to determine the mean value NAV of the engine speed Ne within a predetermined period of time. Then, in a step P74, the mean value NAV is compared with a reference value A. If the mean value NAV is greater than the reference value A, the lean correction coefficient FLEAN stored in the predetermined area of the RAM 61C is set to be 0.92 in a step P75, thereby to permit the execution of the lean control. To the contrary, if the mean value NAV is smaller than the reference value A, the lean correction coefficient FLEAN is set to be 1.0, thereby to permit the execution of the feedback control. In case that the cooling water temperature THW is below 80° C. or the throttle valve 9 is not fully closed, negative answer is made in the step P71 or P72, so that the correction coefficient FLEAN is set to be 1.0. In such a case, therefore, the lean control is not executed but the feedback control becomes possible.

The corrected injection time duration $\tau$ is determined in the step 17 shown in FIG. 5 using various correction coefficients which are determined in the manner explained hereinbefore. Then, the process jumps to the step P4 in the flow chart shown in FIG. 3 in which a voltage correction computing process is conducted to determine the final injection time duration $F\tau$.

Figure 17:
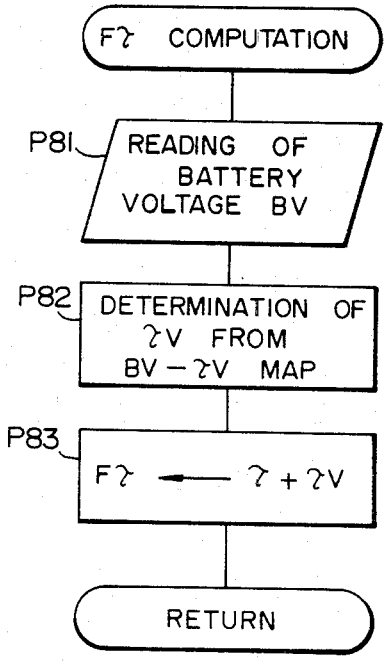
FIG. 17 is a flow chart showing an example of the process for computing the final fuel injection time duration $F\tau$.
Figure 18:
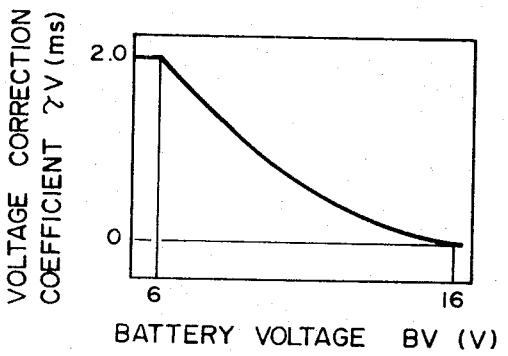
FIG. 18 is a graph showing the battery voltage BV and the voltage correction coefficient $\tau V$.

The voltage correction computing process in the step P4 of the flow chart shown in FIG. 3 is executed by a voltage correction computing routine shown in FIG. 17. In a step P81, the battery voltage BV is read in terms of a battery voltage signal S14. In the next step P82, using the thus read battery voltage BV, a voltage correction coefficient $\tau V$ is determined on a map which shows, as will be seen from FIG. 18, the relationship between the battery voltage BV and the voltage correction coefficient $\tau V$. In a step P83, computation of $(\tau+\tau V)$ is conducted to determine the final injection time duration $F\tau$. The process then returns to the step P5 shown in FIG. 3. If the present instant coincides with the injection timing, an injection signal S12 corresponding to the final injection time duration $F\tau$ is delivered from the control circuit 61 to the injector 7, thereby to drive the latter.

The intake air temperature correction coefficient FTHA, which is determined in the step P16 shown in FIG. 5, is intended for the compensation for the variance of the density of the intake air attributable to the change in the air temperature.

As will be understood from the foregoing description, in the described embodiment of the invention, the basic fuel injection time duration TP is multiplied by the lean correction coefficient FLEAN=0.92 to maintain the air-fuel ratio at the leaner side of the stoichiometric level, only when the mean value NAV of the engine speed within a predetermined period is higher than a predetermined reference value while the engine is idling after the warming up of the same. Thus, even when the engine is idling after the warming up, the lean correction coefficient FLEAN is set at 1.0 at any time the mean value NAV of the engine speed falls below the reference value, thereby to permit a feedback control for maintaining the air-fuel ratio around the stoichiometric level.

According to the invention, therefore, it is possible to avoid the troubles such as unstable engine operation or the engine stall even if the lean control is conducted during the idling after the warming up of the engine. In the described embodiment, the learning control amount TAG for the learning control of the air-fuel ratio is computed when all of the following conditions are met: namely, the throttle valve 9 is fully closed; the engine is under the feedback control; the engine speed Ne is below a predetermined speed; and the intake pressure PM is higher than a predetermined pressure, and the basic fuel injection time duration is corrected in accordance with at least the learning control amount TAG over the whole region of the engine operation. Also in the described embodiment of the invention, even if the lean control is executed in the idling of the engine after the warming up, the lean control is not effected but the feedback control is conducted instead, provided that the mean value NAV of the engine speed is below a reference value. It is, therefore, possible to increase the chance of the learning of the above-mentioned learning correction amount TAG and, hence, to conduct the control of the air-fuel ratio delicately and precisely.

An explanation will be made hereinunder as to another example of the process for computing the lean correction coefficient FLEAN. With specific reference to FIG. 19, in this example, the lean control is carried out in all operational conditions of the engine.

Figure 19:
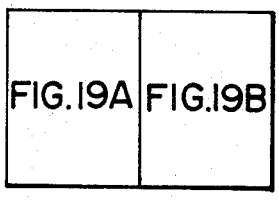
FIGS. 19, 19A and 19B are flow charts showing another example of the process for computing the lean correction coefficient FLEAN.
Figure 19A:
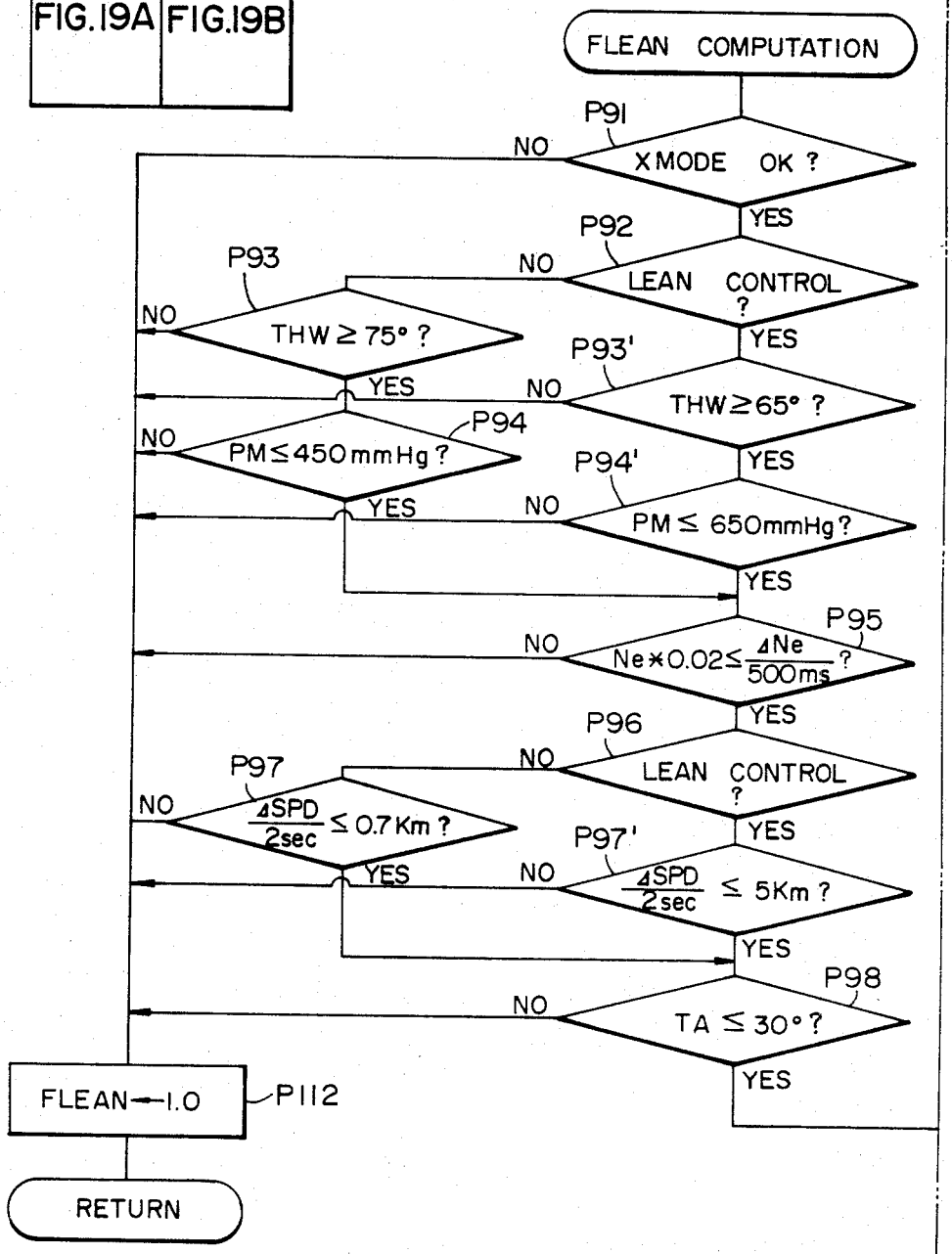
Figure 19B:
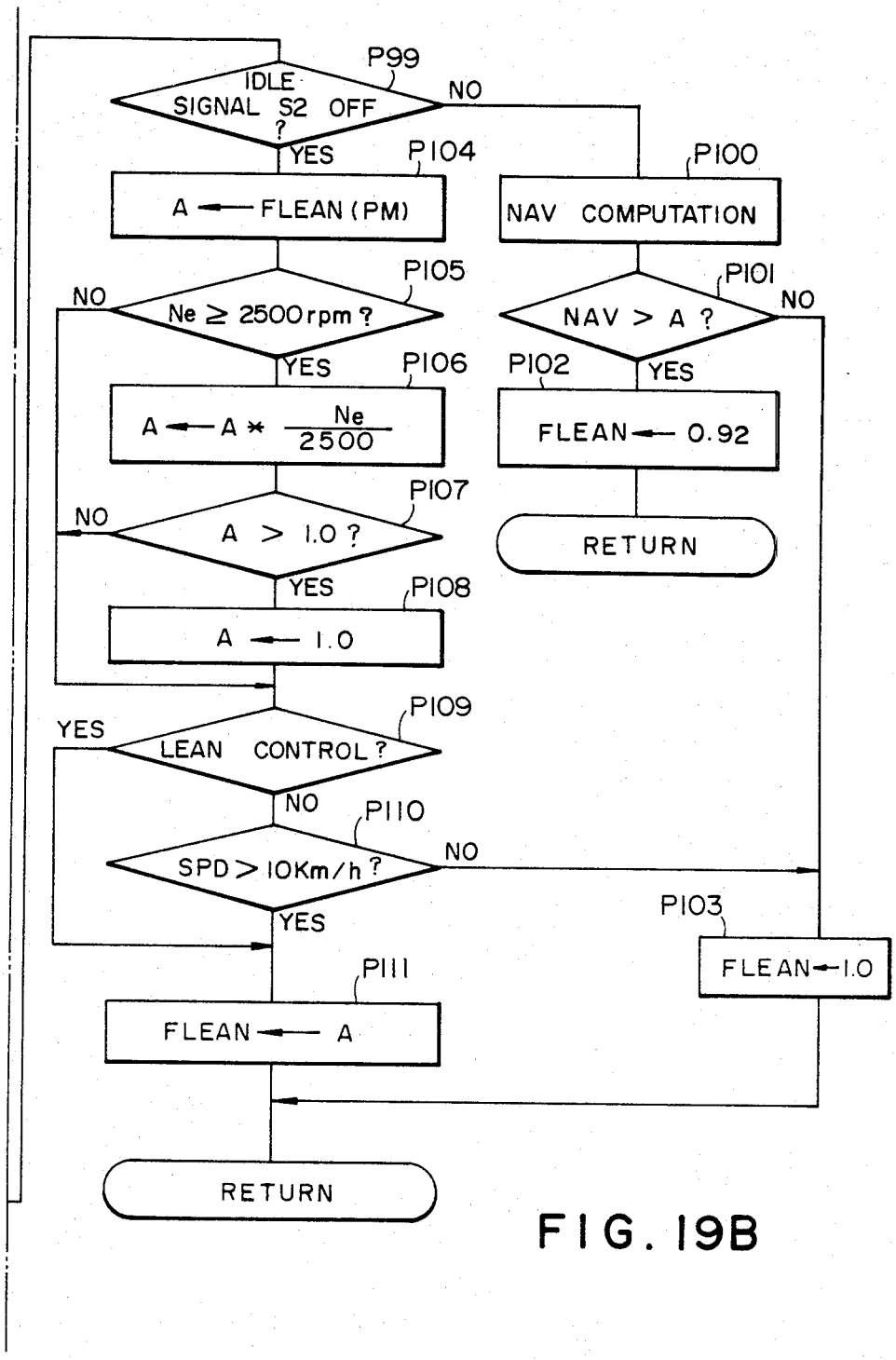

As a program as shown in FIG. 19 is started, a judgement is made in a step P91 as to whether the mode condition XMODE is satisfied or not. More specifically, this condition is satisfied when the engine is not being started up nor in the post-start fuel incremental phase nor in the power incremental mode. The judgement as to whether or not the engine is not being started up is made in accordance with the start signal S9 and the engine speed signal S10. The judgement concerning the post-start fuel incremental mode after the starting is made on the basis of post-start fuel incremental coefficient FSE stored in a predetermined memory area. The judgement in regard to the power incremental phase is made through judgement of the power incremental coefficient FPO stored in a predetermined memory area. If this condition XMODE is met, a judgement is made in a step P92 as to whether or not the engine is operating in the lean control mode. This judgement is made by disriminating the state of the lean correction coefficient FLEAN stored in the predetermined area of the RAM, i.e. whether the coefficient FLEAN is 1.0 or not. If the coefficient FLEAN is 1.0, it is judged that the engine is operating in the feedback control mode for maintaining the mixture at the stoichiometric level of air-fuel ratio, i.e., it is judged that the lean control is not executed.

When the judgement in the step P92 proved that the engine is operating in the feedback control mode, the process can proceed to a step P95 for executing the lean control, provided that the cooling water temperature THW is judged to be 75° C. or higher in a step P93 and that the intake pressure PM is judged to be less than 450 mmHg in a step P94.

If the judgement in the step P92 proves that the engine is operating in the lean control mode, the process proceeds to a step P93' in which a judgement is made as to whether or not the cooling water temperature is 65° C. or more. If the answer is affirmative, the process proceeds to the next step P94' in which a judgement is made as to whether or not the intake pressure PM is 650 mmHg or less. If the intake pressure PM is 650 mmHg or less, i.e. if the engine is operating under a light or medium load, the process proceeds to the next step P95.

In the step P95, a judgement is made as to whether or not the rate ΔNe/500 ms of change in the engine speed Ne is within 2% of the engine speed. If the answer is affirmative, a judgement is made in a step P96 as to whether or not the engine is in the lean control mode, in the same manner as that in the step P92 mentioned before. If the engine is not in the lean control mode, the process proceeds to a step P97 in which a judgement is made as to whether or not the rate ΔSPD/2 sec of change of the vehicle speed SPD is a first reference value of, for example, 0.7 Km or less. However, if the engine is operating in the lean control mode, a judgement is made in a step P97' as to whether or not the rate ΔSPD/2 sec of vehicle speed SPD is a second reference value of, for example, 5 Km/sec or less.

In this embodiment, the use of different judging levels in the steps P93, P93', P94, P94', P97 and P97' is intended for elimination of hunting of the engine.

If an affirmative answer is obtained in the step P97 or P97', the process proceeds to a step P98 in which a judgement is made as to whether or not the opening degree of the throttle valve 9 is a predetermined reference value which is, for example, 30° or less. If the answer is affirmative, the process proceeds to a step P99 in which a judgement is made as to whether the throttle valve 9 is fully closed or not, through discriminating whether the state of the idle signal S2 is on or off. When the idle signal S2 is in the on state, i.e. when the throttle valve 9 is fully closed, the process proceeds to a step P100. In this step P100, a computation is made to determine the mean value NAV of the engine speed in the same manner as that explained before.

In a next step P101, the mean value NAV is compared with a reference value A. If the mean value NAV exceeds the reference value A, the lean correction coefficient FLEAN stored in the predetermined area of RAM61C is set to be 0.92 to allow the execution of the lean control. However, when the mean value NAV is smaller than the reference value A, the lean correction coefficient FLEAN is set to be 1.0 in the step P103 to permit the execution of the feedback control.

On the other hand, if the judgement in the step P99 has proved that the throttle valve 9 is not fully closed, the lean correction coefficient FLEAN is read on the basis of the read value of the intake pressure PM, from a map which is stored in the ROM **61*b*. As will be seen from FIG. 20, this map shows the relationship between the intake pressure PM and the lean correction coefficient FLEAN. After storing the thus read lean correction coefficient FLEAN in the register A, the process proceeds to a step 105**.

In the step P105, a judgement is made as to whether or not the engine speed Ne is a predetermined speed which is, for example, 2500 rpm or more.

If the answer is affirmative, i.e. when the engine is operating at a high speed, the content of the register A is multiplied in a step P106 by a coefficient which is given by Ne/2500 so as to shift the air-fuel ratio to the richer side, in order to avoid the occurrence of surging of the engine.

In the step P107, a judgement is made as to whether or not the multiplied value newly stored in the register A is greater than 1.0. If so, the content of the register A is rewritten to be 1.0 in a step P108 and the process proceeds to a step P109. The step P109 is taken also when a negative answer is obtained in the step P105 or P107.

A judgement is made in the step P109 as to whether or not the engine is operating in the lean control mode, in the same manner as that described before in connection with the steps P92 and P96. When the engine is not in the lean control mode, i.e. when the engine is in the feedback control mode, a judgement is made in a step P110 in which as to whether or not the vehicle speed SPD exceeds a predetermined speed of, for example, 10 Km/h. If this predetermined speed is exceeded, the process proceeds to a step P111. However, if this speed is not exceeded, the process is finished after setting the lean correction coefficient FLEAN at 1.0 in a step P103 so as to prohibit the lean control.

On the other hand, when the judgement in the step P109 proves that the engine is operating in the lean control mode, the process proceeds to a step P111 skipping over the step P110.

In the step P111, the value of the lean correction coefficient FLEAN stored in the predetermined area in the RAM **61*c*** is set up in the register A, thus completing this computing process.

If a negative answer is obtained in each of the steps P91, P93, P94, P93', P94', P95, P97, P97' and P98, the process proceeds to a step P112 in which the value of the lean correction coefficient FLEAN in the predetermined area of the RAM **61*c*** is set at 1.0, thus finishing the computing process. In this case, the lean control is not conducted.

In this embodiment, the lean control or the feedback control is conducted in the same way as that explained before provided that the throttle valve 9 is closed fully. However, if the throttle valve 9 takes a position other than the full close position, it is allowed to conduct the lean control in accordance with the intake pressure PM, thereby to further decrease the fuel consumption.

Although the invention has been described through specific embodiments, it is to be noted that the described embodiments are not exclusive. Namely, the invention can be applied equally to all internal combustion engine which employs the feedback control for maintaining the air-fuel ratio approximately the stoichiometric value in accordance with the actual air-fuel ratio read through the detection of the composition of the exhaust gas, as well as a lean control for maintaining the air-fuel ratio at the leaner side of the stoichiometric level during idling after the warming up of the engine.

In the described embodiment of the invention, the basic fuel injection time duration TP is determined on the basis of the engine speed and the intake pressure. This, however, is only illustrative and the basic fuel injection time duration TP may be determined on the basis of the engine speed and the intake air flow rate. Needless to say, it is possible to detect the temperature of the engine oil or the cylinder block as the engine temperature, in place of the cooling water temperature. In addition, the correction of the basic fuel injection time duration may be conducted by other method than that described, e.g. by a simplified method or a method which is complicated to attain a higher precision of the control.

What is claimed is:

1. A method of controlling the air-fuel ratio of an air-fuel mixture to be supplied to an internal combustion engine having an injector by selectively using a feedback control in which the air-fuel ratio is maintained at the stoichiometric level and a lean control in which the air-fuel ratio is maintained at a leaner side of the stoichiometric level at least during an idling of the engine after a warming up of the engine, said method comprising the steps of:

calculating a mean value of the engine idling speed for a predetermined period of time;

comparing the mean value thus calculated with a predetermined reference value;

prohibiting said lean control at least when said comparing step determines that the mean value is less than the predetermined reference value, whereby the air-fuel ratio is feedback-controlled with said feedback control so as to be maintained at the stoichiometric ratio;

computing a basic fuel injection time duration corresponding to a fuel injection rate of said injector in accordance with an engine speed and a load on the engine; and correcting said basic fuel injection time duration in the lean control by at least a lean correction coefficient and in the feedback control by at least a feedback correction coefficient to thereby determine a final injection time duration, said lean correction coefficient being determined in accordance with a load on the engine such that the air-fuel ratio is in a leaner side of the stoichiometric air-fuel ratio, and said feedback correction coefficient being determined in accordance with the actual air-fuel ratio such that the air-fuel ratio substantially becomes a stoichiometric level, wherein when the result of said comparing step is that the mean value is less than the predetermined reference value, a correction of the basic injection time duration by the lean correction coefficient is prohibited.

2. A method of controlling the air-fuel ratio according to claim 1, wherein when a condition for the lean control is satisfied under an operational condition of the engine other that the engine idling condition, the air-fuel ratio is determined in accordance with a level of an intake pressure to be maintained at the leaner side of the stoichiometric air-fuel ratio.

3. A method of controlling the air-fuel ratio according to claim 1, wherein the air-fuel ratio in the lean control is fixed at a certain value.

4. A method of controlling the air-fuel ratio of an air-fuel mixture to be supplied to an internal combustion engine by selectively using a feedback control in which the air-fuel ratio is maintained at the stoichiometric level and a lean control in which the air-fuel ratio is maintained at a leaner side of the stoichiometric level at least during an idling of the engine after a warming up of the engine, said method comprising the steps of:

(a) calculating a mean value of the engine idling speed for a predetermined period of time;

(b) comparing the mean value thus calculated with a predetermined reference value;

(c) prohibiting said lean control at least when said comparing step determines that the mean value is less than the predetermined reference value, whereby the air-fuel ratio is feedback-controlled in the feedback control so as to be maintained at the stoichiometric ratio, and wherein when a condition for the lean control is satisfied under an operational condition of the engine other than the engine idling condition, the air-fuel ratio is determined in accordance with a level of an intake pressure to be maintained at the leaner side of the stoichiometric air-fuel ratio.

5. A method of controlling the air-fuel ratio according to claim 4, wherein the air-fuel ratio in the lean control is fixed at a certain value.

6. An apparatus for controlling the air-fuel ratio of an air-fuel mixtuure to be supplied to an internal combustion engine with an injector and a throttle valve controlling an intake flow rate of the engine, said apparatus comprising:

(a) an actual engine speed detecting means for detecting an actual speed of said engine;

(b) a load detecting means for detecting a load applied to said engine;

(c) a temperature detecting means for detecting a temperature of said engine;

(d) an idle detecting means for producing an idle signal when said throttle valve is substantially fully closed;

(e) an air-fuel ratio detecting means for detecting said air-fuel ratio through a detection of a component of an exhaust gas of said engine;

(f) a mean engine speed detecting means for detecting a mean speed of said engine over a predetermined period when said idle signal is produced;

(g) a warm-up judging means for judging that warming up of said engine is finished when an engine temperature detected by said engine temperature detecting means exceeds a predetermined temperature;

(h) a comparing means for comparing said mean engine speed detected by said mean engine speed detecting means with a predetermined reference value;

(i) a computing means for computing basic fuel injection time duration corresponding to an opening period of said injector in accordance with said actual engine speed detected by said actual engine speed detecting means and said load detected by said load detecting means;

(j) a correcting means for correcting said basic fuel injection time duration in order to maintan said air-fuel ratio at a leaner side of stoichiometric level when said comparing means determines that said mean engine speed exceeds said reference value while said warm-up judging means determines that said warming up of said engine has been finished, said correcting means further for correcting said basic fuel injection time duration in accordance with said air-fuel ratio detected by said air-fuel ratio detecting means so as to maintain said air-fuel ratio substantially at said stoichiometric level, at least when said mean engine speed is determined by said comparing means to be lower than said reference value; and (k) a signal generating means for generating an injection signal for driving said injector over a period of time corresponding to the corrected injection time duration which is obtained by correcting said basic fuel injection time duration by said correction means.

7. An apparatus for controlling the air-fuel ratio of an air-fuel mixture to be supplied to an internal combustion engine, comprising:

control means for selectively using feedback control to maintain said air-fuel ratio at a stoichiometric level and using lean control to maintain said air-fuel ratio at a leaner side of said stoichiometric level at least during idling of said engine after a warming up of said engine;

means for calculating a mean value of idling speed of said engine for a predetermined period of time;

means for comparing said mean value with a predetermined reference value;

means for prohibing said lean control operation of said control means when said comparing means determines that said mean value is less than said predetermined reference value, so that said air-fuel ratio is maintained by said feedback control operation of said control means;

an injector for said engine;

means for computing a basic fuel injection time duration corresponding to a fuel injection rate of said injector in accordance with an engine speed and a load on said engine; and means for correcting said basic fuel injection time duration during said lean control operation by at least a lean correction coefficient and during said feedback control operation by at least a feedback correction coefficient to thereby determine a final injection time duration, said lean correction coefficient being determined in accordance with a load on said engine such that said air-fuel ratio becomes a leaner side of said stoichiometric air-fuel ratio, and said feedback correction coefficient being determined in accordance with an actual air-fuel ratio such that said air-fuel ratio substantially becomes stoichiometric level; and wherein said means for correcting, when said comparing means determines that said mean value is less than said predetermined reference value, prohibits correction of said basic injection time duration by said lean correction coefficient.

8. An apparatus for controlling the air-fuel ratio according to claim 7, wherein said control means includes means for, when a condition for lean control operation is satisfied under an operational condition of said engine other than said engine idling condition, determining said air-fuel ratio in accordance with a level of an intake pressure of said engine to be maintained at a leaner side of said stoichiometric air-fuel ratio.

9. An apparatus for controlling the air-fuel ratio according to claim 7, wherein during said lean control operation, said air-fuel ratio is fixed at a certain value.

10. An apparatus for controlling the air-fuel ratio of an air-fuel mixture to be supplied to an internal combustion engine, comprising:

control means for selectively using feedback control to maintain said air-fuel ratio at a stoichiometric level and using lean control to maintain said air-fuel ratio at a leaner side of said stoichiometric level at least during idling of said engine after a warming up of said engine;

means for calculating a mean value of idling speed of said engine for a predetermined period of time;

means for comparing said mean value with a predetermined reference value; and means for prohibiting said lean control operation of said control means when said comparing means determines that said mean value is less than said predetermined reference value, so that said air-fuel ratio is maintained by said feedback control operation of said control means;

wherein said control means includes means for, when a condition for lean control operation is satisfied under an operational condition of said engine other than said engine idling condition, determining said air-fuel ratio in accordance with a level of an intake pressure of said engine to be maintained at a leaner side of said stoichiometric air-fuel ratio.

11. An apparatus for controlling the air-fuel ratio according to claim 10, wherein during said lean control operation, said air-fuel ratio is fixed at a certain value.

* * * * *